United States Patent [19]

Aiken

[11] 4,224,815

[45] Sep. 30, 1980

[54] KEY HOLDER

[76] Inventor: Wade B. Aiken, 215 Holly St., Mt. Holly, N.C. 28120

[21] Appl. No.: 594,068

[22] Filed: Jul. 8, 1975

Related U.S. Application Data

[63] Continuation of Ser. No. 371,888, Jun. 20, 1973, abandoned.

[51] Int. Cl.[2] ..... A47G 29/10

[52] U.S. Cl. ..... 70/457; 70/458

[58] Field of Search ..... 70/456–459; 24/266, 114.5

[56] References Cited

U.S. PATENT DOCUMENTS

| | | | |
|---|---|---|---|
| 1,442,531 | 1/1923 | Mather | 24/266 X |
| 2,596,374 | 5/1952 | Crapster | 116/133 |
| 2,631,449 | 3/1953 | Protsman | 70/457 |
| 3,083,428 | 4/1963 | McGill | 24/114.5 |

FOREIGN PATENT DOCUMENTS

| | | | |
|---|---|---|---|
| 1525209 | 4/1968 | France | 70/457 |

*Primary Examiner*—Robert L. Wolfe
*Attorney, Agent, or Firm*—Eric P. Schellin

[57] ABSTRACT

A key holder consisting of a short tubular member and a single strand, preferably of solid nylon monofilament, passed one or more times through openings of keys and through said tubular member, said strand having end portions extending in opposite directions through the tubular member and terminating in integral enlargements or knobs each of a size to prevent its passage through the tubular member for attaching the strand and the keys mounted thereon to the tubular member. Said knobs or enlargements are formed by subjecting the terminals of the strand to heat, and either terminal portion can be sheared off for detaching the strand from the tubular member and keys.

1 Claim, 4 Drawing Figures

KEY HOLDER

This is a continuation of application Ser. No. 371,388, filed June 20, 1973 now abandoned.

SUMMARY

It is a primary object of the present invention to provide a key holder of extremely simple construction which may be very economically manufactured and sold and which is capable of effectively and securely holding one or a plurality of keys, without risk of loss of a key from the holder.

Another object of the invention is to provide a key holder which can be assembled in different ways for holding the keys either together or separated.

Still a further object of the invention is to provide a key holder which is extremely light in weight enabling it to be most conveniently carried in a garment pocket.

Various other objects and advantages of the invention will hereinafter become more fully apparent from the following description of the drawing, illustrating a presently preferred embodiment thereof, and wherein:

DESCRIPTION OF THE PREFERRED EMBODIMENT

Figure 1:
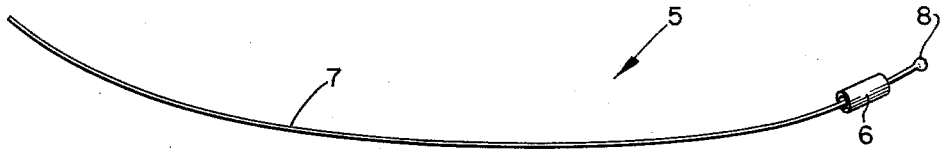
FIG. 1 is a plan view showing the key holder before assembly.

Referring more specifically to the drawing, the key holder in its entirety is designated generally 5 and comprises a tubular member 6 and a strand 7 of a plastic material, preferably solid nylon monofilament, not readily subject to breakage. The tubular member 6 is illustrated as a short sleeve but could constitute a ring having an opening of a diameter corresponding to the diameter of the bore of the sleeve 6. An enlargement or knob 8 is shown on one end of the strand 7. Said enlargement is integral with the strand and is formed by subjecting said end to heat, as by holding a lighted match 9, FIG. 3, beneath the strand end to cause the strand end to fuse.

Figure 2:
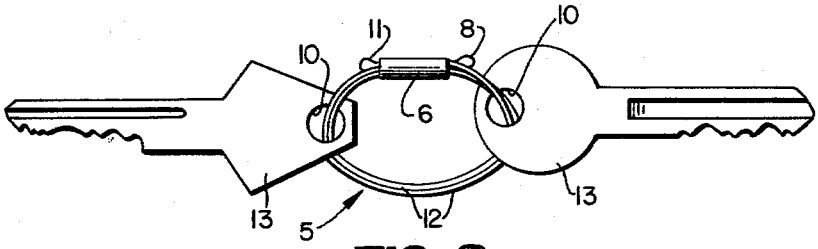
FIG. 2 is a plan view illustrating one manner of assembling the key holder.

The other end of the strand end 7 is then passed through the usual openings or eyes 10 of one or more keys 13 and through the sleeve 7 one or more times so that said other end portion will protrude beyond the other end of the sleeve from the end thereof beyond which the knob 8 is disposed. A knob 11, corresponding to the knob 8, is then formed in the same manner of said other end of the strand 7. The knobs 8 and 11 are too large to pass through the sleeve 6, so that said sleeve functions to retain the strand 7 in the form of one or more loops 12, two loops being shown in FIG. 2, on which the keys 13 are strung.

Figure 3:
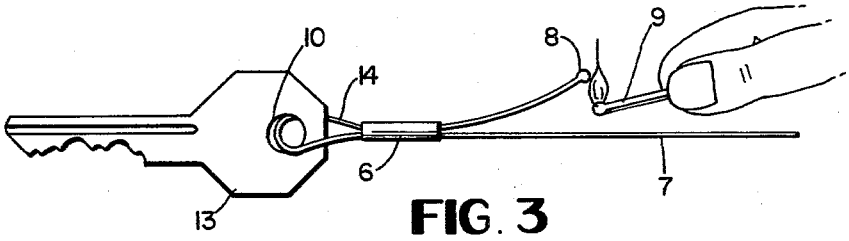
FIG. 3 is a plan view showing the key holder partially assembled in a second manner.
Figure 4:
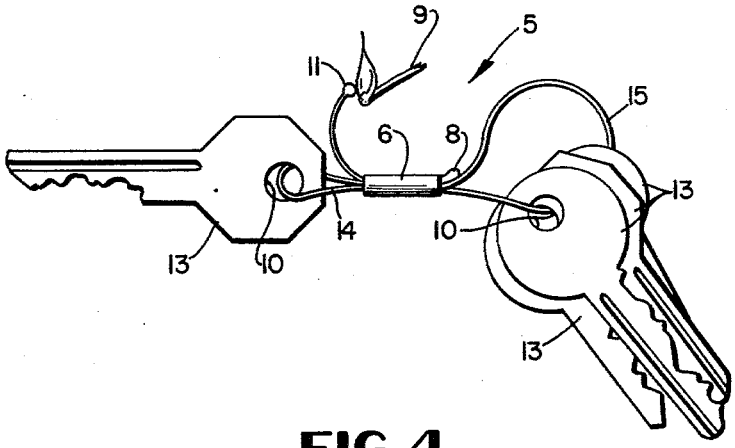
FIG. 4 is a similar view showing complete assembly of the key holder in the second form.

FIGS. 3 and 4 illustrate another arrangement of the strand end 7 relative to the sleeve 6. After the knob 8 is formed by the lighted match 9, as previously described, on one end of the strand 7, the other end thereof is passed through the eye 10 of a key 13 and then back through the sleeve 6 toward the knob 8 to form a loop 14. Said strand end is then passed through the eyes 10 of one or more additional keys 13 and then back in the opposite direction through the sleeve 6 to form a second loop 15, which may be larger than the loop 14. The knob 11 is then formed by the lighted match 9 on said other strand terminal, as seen in FIG. 4, after which the loop 15 can be pulled and enlarged to draw the knob 11 to a position adjacent the end of the sleeve, as in FIG. 2.

With the arrangement of the holder 5, as seen in FIG. 4, a single key, such as a door key or ignition key, which is most frequently used, can be separated from the remainder of the keys being carried, so that it can be located without any inconvenient, especially in the dark. Obviously, more than one key could be retained on the loop 14.

To remove a key or apply additional keys to the holder 5, it is only necessary to cut off the strand 7 adjacent either knob 8 or 11 and thereafter reform another knob, in the same manner as illustrated in FIGS. 3 and 4, after the key or keys have been removed or added.

Various modifications and changes are contemplated and may be resorted to, without departing from the function or scope of the invention.

I claim as my invention:

1. A key holder having two loop portions to retain keys, the holder comprising a tubular member having a bore, elongated strand means of monofilament nylon for engaging said keys, said strand means having a cross-sectional diameter substantially less than the cross-sectional diameter of said bore whereby portions of said strand may be passed three times through the said tubular member, said strand having end portions extending through said bore in opposite directions, the said loop portions being formed by the remainder of the said elongated strand, one loop positioned at one end of said tubular member and another loop positioned at the other end of said tubular member, an integral enlargement means formed on at least one end of said strand for preventing passage of said end through said bore of said tubular member, said integral enlargement means comprising fused nylon formed by heating at least one end of said strand to above the softening point of the strand material to gather a quantity of the monofilament nylon which upon being cooled to ambient temperatures results in said integral enlargement.

* * * * *